United States Patent [19]

Gruenwald

[11] Patent Number: 4,576,761

[45] Date of Patent: Mar. 18, 1986

[54] FUEL FLOW DEFLECTOR FOR USE IN A CARBURETOR

[75] Inventor: David J. Gruenwald, Oshkosh, Wis.

[73] Assignee: Brunswick Corporation, Skokie, Ill.

[21] Appl. No.: 732,112

[22] Filed: May 9, 1985

[51] Int. Cl.[4] ..... F02M 5/02

[52] U.S. Cl. ..... 261/23 A; 261/DIG. 50; 261/72 R

[58] Field of Search ..... 261/23 A, DIG. 50, 72 R, 261/50 A, 34 R

[56] References Cited

U.S. PATENT DOCUMENTS

| | | | |
|---|---|---|---|
| 2,628,826 | 2/1953 | Worden | 261/DIG. 50 |
| 3,372,912 | 3/1968 | Benmore | 261/DIG. 50 |
| 4,168,289 | 9/1979 | Saunion | 261/DIG. 50 |
| 4,350,124 | 9/1982 | Kitano et al. | 261/DIG. 50 |
| 4,353,847 | 10/1982 | Sato et al. | 261/DIG. 50 |
| 4,464,312 | 8/1984 | Zaita | 261/72 R |

*Primary Examiner*—Tim Miles
*Attorney, Agent, or Firm*—O. T. Sessions

[57] ABSTRACT

An adaptor (27) is provided in the float bowl (11) of a carburetor (10) to force the secondary fuel passage (18) to draw fuel from the center of the float bowl (11). A cap (31) is provided at the top of the adaptor (27) to seal the top of the adaptor (27) while allowing the secondary metering rods (19) to extend through the adaptor (27).

7 Claims, 4 Drawing Figures

FUEL FLOW DEFLECTOR FOR USE IN A CARBURETOR

TECHNICAL FIELD

This invention relates to carburetors for supplying an air/fuel mixture to internal combustion engines and particularly to a device for modifying the flow of fuel to orifices in the float bowl of such a carburetor.

BACKGROUND ART

Carburetors are often designed for use in a particular orientation. For example, the location of the nozzles in the bottom of the carburetor float bowl can seriously affect the performance of the carburetor under differing acceleration conditions. If the secondary nozzles, used for acceleration and high speed, are located at the rear of the carburetor bowl, forward acceleration will normally push fuel back and keep the secondary nozzles covered with fuel during periods of forward acceleration. Occasionally, however, it is desirable to change the orientation of the carburetor for particular installations. If such a carburetor with the secondary nozzles normally located at the rear of the carburetor is rotated 90° or 180° lateral or forward accelerations may cause the fuel to uncover the secondary nozzles thus causing poor engine performance.

DISCLOSURE OF INVENTION

One of the objects of this invention is to provide an adaptor which will cause the nozzles in a carburetor float bowl to draw fuel from a different location in the float bowl. Another object of the invention is to provide an adaptor which will allow an existing carburetor to function in various orientations. Yet another object of the invention is to provide such an adaptor which may be easily installed in the carburetor with no change to the pre-existing carburetor structure.

The present invention provides an adaptor for a carburetor having a float bowl, an inlet valve controlled by a float in the float bowl to maintain a constant fuel level in the float bowl, an induction passage for supplying air/fuel mixture to an engine, and a fuel passageway for supplying fuel from the float bowl to the induction passage. The fuel passageway of the carburetor includes an orifice positioned near the bottom of the float bowl and an axially movable metering rod extending into the orifice to control the effective area of the orifice. The adaptor includes an enclosure placed over the carburetor nozzle to define a chamber above the nozzle. The enclosure includes an upper hole closely fitting the metering rod and a bottom open to the carburetor nozzle. A passage is provided connecting the chamber with a portion of the float bowl remote from the orifice.

The adaptor can include a body with a cap placed on the upper portion of the body, with the hole for the metering rod formed through the cap. In such an arrangement, the cap can be loosely fitted on the body to accommodate lateral movement of the metering rod. Preferably a retainer is provided to hold the cap on the body.

The adaptor passage can be defined by a channel formed in the bottom portion of the adaptor and the bottom of the float bowl. Preferably the passage should open near the bottom center of the float bowl.

Preferably the adaptor should be designed to include portions engaging opposite sides of the float bowl to retain the adaptor in position. The adaptor should also include elements engaging the top and bottom of the float bowl to hold the adaptor in position.

BEST MODE FOR CARRYING OUT THE INVENTION

Figure 1:
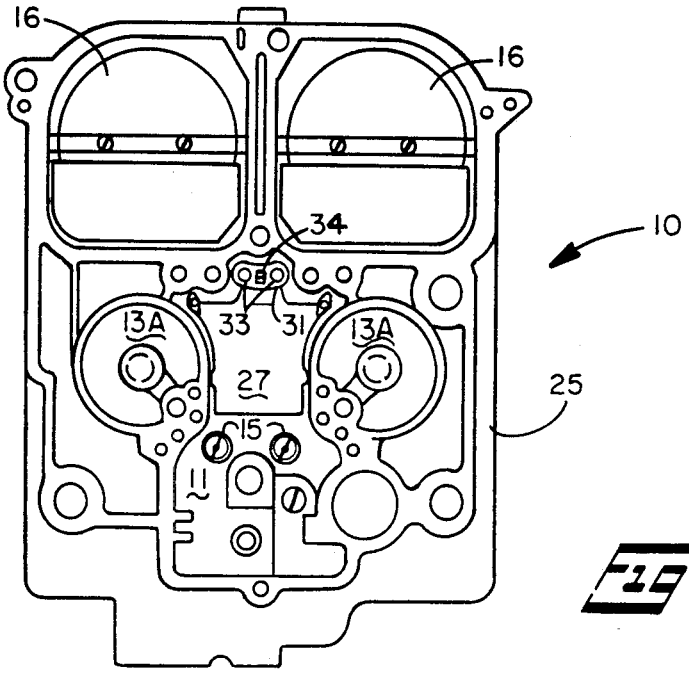
FIG. 1 is a top view of the float bowl of the carburetor with its cover removed, showing the position of the adaptor of the invention.
Figure 2:
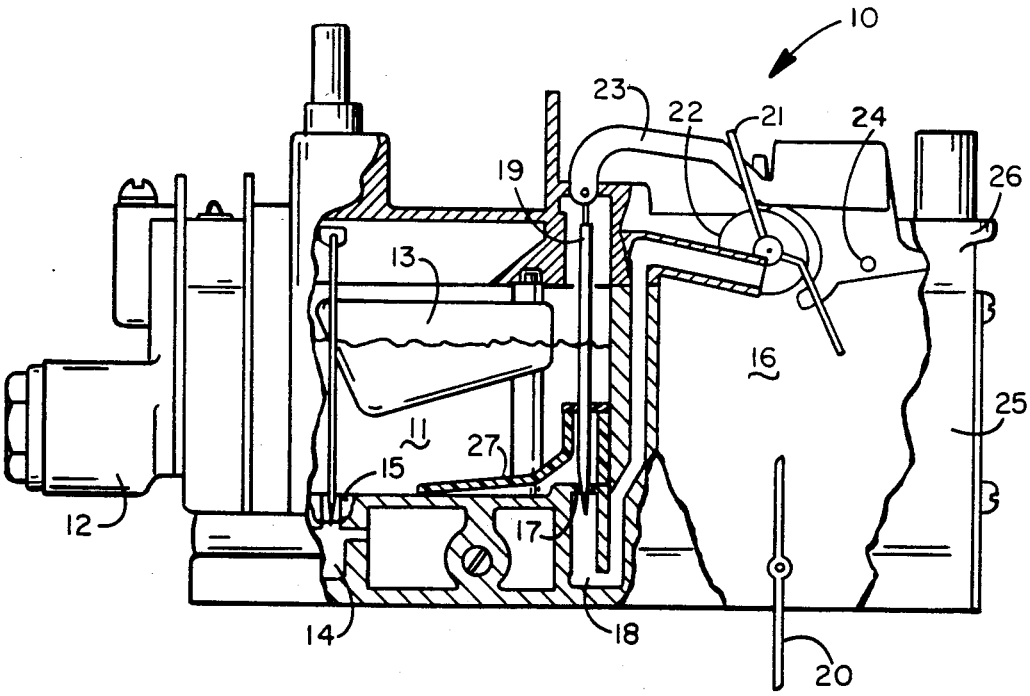
FIG. 2 is a sectional view of the carburetor of FIG. 1, taken along line 2—2, showing the adaptor of the invention in place.
Figure 3:
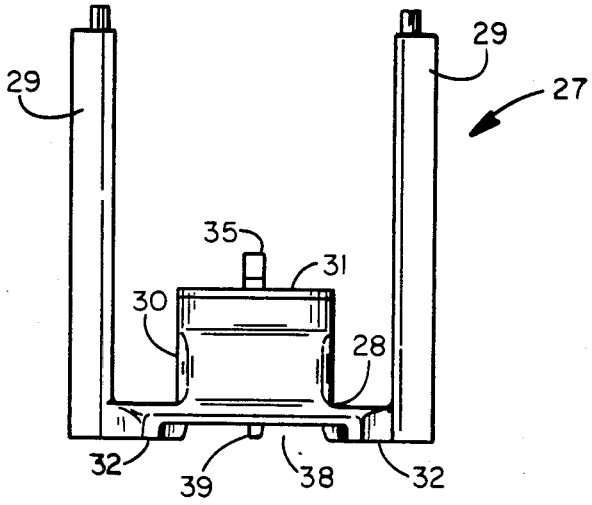
FIG. 3 is an end view of the adaptor of the invention.
Figure 4:
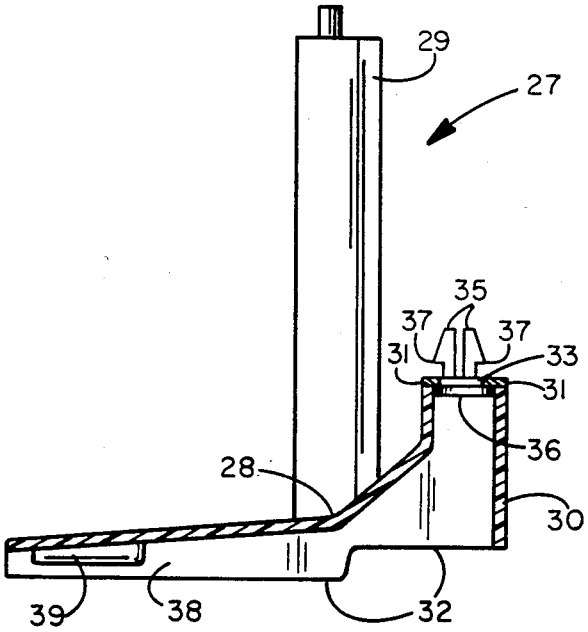
FIG. 4 is an enlarged view of the adaptor taken in the same plane as FIG. 2.

FIGS. 1 and 2 show the adaptor of the invention installed in the float bowl of a carburetor. The carburetor illustrated is a QUADRAJET carburetor available from the Rochester Products Division of General Motors Corporation. Since this carburetor is well known and widely used, it will only be described here in sufficient detail to illustrate the present invention.

As most clearly shown in FIG. 2, the carburetor 10 includes a float bowl 11 supplied with fuel from an external source through the fuel inlet 12. The level of fuel in the float bowl 11 is controlled by a float valve, not illustrated, and float 13 in a conventional manner. Fuel from the float bowl 11 is supplied to a venturi in the primary induction passage 13A through a passage 14 leading from the primary orifice 15. Fuel is supplied from the float bowl 11 to the secondary induction passage 16 through an orifice 17 located in the bottom of the float bowl 11 and a fuel passage 18. The area of the secondary orifice 17 which is effective to pass fuel is controlled by a secondary metering rod 19 which is tapered at its lower end. Operation of the secondary metering system is controlled by a secondary throttle valve 20. When the secondary throttle valve 20 is opened, as illustrated, vacuum from the engine will cause the air valve 21 to open. A cam 22 of the shaft of the air valve will then rotate to lift the metering rod lever 23 mounted on a pivot 24. The degree of vacuum in the secondary passage 16 will control the rotation of the air valve 21 and thus the lift of the metering rod lever 23. The secondary metering rod 19 supported by the metering rod lever 23 is thus effective to control the effective area of the secondary metering orifice 17.

The carburetor float bowl 11 is formed by the main body casting 25 and the air horn casting 26. During operation in the low and intermediate engine speed ranges, fuel is supplied to the engine by the primary induction passage 13A and the secondary induction passage 16 will remain closed by the secondary throttle valve 20. In the high speed range of during heavy acceleration, however, the secondary throttle valve 20 will be opened and vacuum from the engine will open the air valve 21 thus opening the secondary orifices 17 and drawing fuel through the secondary fuel passage 18 into the secondary induction passage 16. Thus the secondary metering system will be used primarily during periods of acceleration and wide open throttle use. The normal orientation of the carburetor 10 has the fuel inlet 12 in the forward position. Forward acceleration will then force fuel to the rear and keep the secondary orifices 17 covered with fuel. If the carburetor 10 is placed in a different orientation, either sideways or reversed, lateral accelerations or increasing speed of the vehicle on which the carburetor 10 is mounted may draw fuel away from the secondary orifices 17. This condition can cause the engine to run lean and reduce engine performance.

The fuel flow directing adaptor 27 of the present invention is intended to cause the secondary fuel passage 18 and orifice 17 to draw fuel from the approximate center of the carburetor float bowl 11. As shown in FIGS. 1 and 2, the adaptor 27 of the invention is placed in the carburetor float bowl 11 over the secondary orifices 17. The body 28 of the adaptor 27 is shaped to conform with the sides and bottom of the carburetor float bowl 11. A column 29 is provided on each side of the body 28 to engage the upper and lower surfaces of the carburetor float bowl 11 to prevent vertical movement of the adaptor 27.

The adaptor 27 includes an enclosure 30 placed over the secondary orifices 17 to define a chamber above the secondary orifices 17. The chamber is large enough to provide clearance for the secondary metering rods 19 in all operating ranges. The enclosure 30 is defined by the body 28 of the adaptor 27 and a cap 31 provided over the open top of the adaptor 27. The bottom edges 32 of the adaptor body 28 fit tightly against the bottom of the float bowl 11 to complete the enclosure 30. The cap 31 is a metal plate having two holes 33 to closely fit the secondary metering rods 19. A rectangular cut out 34 in the center of the cap 31 snaps open over the two projecting arms 35 extending upward from a bridge 36 across the top of the adaptor 27. The rectangular cut out 34 is large enough to allow lateral movement of the cap 31 when the cap 31 is in place, but small enough to prevent the cap 31 from being lifted over the retaining projections 37 on the retainer arms 35. The cap 31 can thus accommodate lateral movement of the secondary metering rods 19 which occurs during their pivotal motion from the metering rod lever 23, while closing the opening in the upper portion of the adaptor body 28.

The lower portion of the adaptor body 28 extends away from the secondary orifices 17 to the center of the float bowl 11. A broad channel 38 is formed in the bottom of the adaptor body 28 to define, with the bottom of the float bowl 11, a fuel passage to direct fuel from the center of the float bowl 11 to the secondary orifices 17. A small support 39 is provided in the middle of the channel 38 to prevent the channel 38 from collapsing.

In operation, when the secondary induction passage 16 is drawing fuel through the secondary fuel passage 18 and secondary orifices 17, the fuel to the orifices 17 will be supplied through the channel 38 in the adaptor body 28 from the bottom center of the carburetor float bowl 11. Since the fuel is being pulled out by reduced pressure in the secondary induction passage 16, the pressure in the passage 38 provided in the adaptor 27 will be reduced, thus tending to seal the passage against the bottom of the float bowl 11. The reduced pressure will also draw the cap 31 down tightly against the body of the adaptor 27 to provide a good seal at the top. Since the secondary orifices 17 will be drawing fuel from the approximate center of the carburetor float bowl 11, they will continue to draw fuel during accelerations which, in the absence of the adaptor 27, would cause the fuel to uncover the secondary orifices 17.

I claim:

1. In a carburetor having a float bowl, an inlet valve controlled by a float in said float bowl to maintain a constant fuel level in said float bowl, an induction passage for supplying an air/fuel mixture to an engine, a fuel passageway for supplying fuel from said float bowl to said induction passage, said fuel passageway including an orifice positioned near the bottom of said float bowl, and an axially movable metering rod extending into said orifice to control the effective area of said orifice; the improvement comprising:

a fuel flow directing adaptor having (A) an enclosure placed over said orifice to define a chamber above said orifice, said enclosure including an upper hole closely fitting said metering rod and a bottom open to said orifice, and (B) a passage connecting said chamber with a portion of said float bowl remote from said orifice.

2. The carburetor defined in claim 1 wherein said enclosure includes a body and a cap placed on the upper portion of said body, with said hole formed through said cap.

3. The carburetor defined in claim 2 wherein said cap loosely fits on said body to accommodate lateral movement of said metering rod.

4. The carburetor defined in claim 3 wherein said body includes a retainer to hold said cap on said body.

5. The carburetor defined in claim 1 wherein the lower portion of said body includes a channel, said channel and the bottom of said float bowl defining said passage.

6. The carburetor defined in claim 5 wherein said passage opens near the bottom center of said float bowl.

7. The carburetor defined in claim 1 wherein portions of said adaptor engage opposite sides of said float bowl.

* * * * *